US010729304B2

(12) United States Patent
Weaver et al.

(10) Patent No.: US 10,729,304 B2
(45) Date of Patent: Aug. 4, 2020

(54) SQUEEGEE

(71) Applicant: Quickie Manufacturing Corporation, Cinnaminson, NJ (US)

(72) Inventors: Jace Weaver, Gilbertsville, PA (US); Ryan Sheckels, Marlton, NJ (US); David Wilusz, Abington, PA (US)

(73) Assignee: Rubbermaid Commercial Products LLC, Huntersville, NC (US)

( * ) Notice: Subject to any disclaimer, the term of this patent is extended or adjusted under 35 U.S.C. 154(b) by 416 days.

(21) Appl. No.: 15/703,734

(22) Filed: Sep. 13, 2017

(65) Prior Publication Data

US 2018/0070790 A1 Mar. 15, 2018

Related U.S. Application Data

(60) Provisional application No. 62/394,150, filed on Sep. 13, 2016.

(51) Int. Cl.
*A47L 13/11* (2006.01)
*A47L 13/12* (2006.01)

(52) U.S. Cl.
CPC ..... *A47L 13/11* (2013.01); *A47L 13/12* (2013.01)

(58) Field of Classification Search
CPC ..... A47L 13/11; A47L 13/12; A47L 13/08; A47L 13/44; A47L 13/46; A47L 13/48
See application file for complete search history.

(56) References Cited

U.S. PATENT DOCUMENTS 1,620,297 A * 3/1927 Lightfoot ..... A47L 13/48 15/45
2,296,949 A * 9/1942 Roberts ..... A46B 3/16 15/205
2,867,835 A * 1/1959 Brown, Jr. ..... A47L 9/06 15/328
2,895,152 A * 7/1959 Vosbikian ..... A47L 13/12 15/116.2
3,571,841 A * 3/1971 Crouser ..... A47L 9/02 15/401
5,165,811 A * 11/1992 MacLeod ..... A47L 1/08 401/140
6,065,890 A * 5/2000 Weitz ..... A47L 1/08 401/146
6,266,839 B1 * 7/2001 Oretti ..... A46B 17/08 15/111
D627,118 S 11/2010 Bensussan et al.

(Continued)

FOREIGN PATENT DOCUMENTS

DE 947636 C * 8/1956 ..... A47L 13/11
GB 2005994 A * 5/1979 ..... A47L 1/06

OTHER PUBLICATIONS

Unger, http://ungercleaning.com/p-938-sanitary-brush.aspx, retrieved via Internet as early as Aug. 24, 2016.

*Primary Examiner* — Joseph J Hail
*Assistant Examiner* — J Stephen Taylor
(74) *Attorney, Agent, or Firm* — Husch Blackwell LLP

(57) ABSTRACT

A squeegee includes a foam blade assembly and a rubber blade secured in and/or to a main body. The foam blade assembly includes a plurality of posts which project through sets of coaxial openings in the main body and rubber blade and a plurality of fastening structures (e.g., nuts) engage the posts to secure the foam blade assembly and rubber blade to the main body.

17 Claims, 7 Drawing Sheets

(56) References Cited

U.S. PATENT DOCUMENTS

| | | | | |
|---|---|---|---|---|
| 7,832,049 | B2 * | 11/2010 | Hollis | A47L 7/0009 15/121 |
| D632,856 | S | 2/2011 | Quinlan | |
| D632,857 | S | 2/2011 | Sgroi et al. | |
| D649,314 | S | 11/2011 | Quinlan et al. | |
| D652,595 | S | 1/2012 | Pottes | |
| 8,398,330 | B2 | 3/2013 | Bensussan et al. | |
| 8,499,404 | B2 | 8/2013 | Spoleti et al. | |
| 8,726,451 | B2 | 5/2014 | Patterson et al. | |
| 8,955,191 | B2 | 2/2015 | Patterson et al. | |
| 2008/0066248 | A1 | 3/2008 | Lin | |
| 2011/0013980 | A1 | 1/2011 | Bensussan et al. | |
| 2015/0305584 | A1 | 10/2015 | Sgroi, Jr. et al. | |
| 2016/0095492 | A1 | 4/2016 | Smith et al. | |
| 2017/0079488 | A1 * | 3/2017 | Takaki | A47L 1/06 |

* cited by examiner

SQUEEGEE

CROSS-REFERENCE TO RELATED APPLICATIONS

This application claims the benefit of U.S. Provisional Application No. 62/394,150, filed Sep. 13, 2016, which is hereby incorporated by reference in its entirety.

FIELD OF THE INVENTION

The present disclosure relates to a cleaning apparatus, and more particularly to a cleaning apparatus having two squeegee blades for cleaning floors.

BACKGROUND OF THE INVENTION

Cleaning devices adapted to clean floors (e.g., brooms) are known and can also include a squeegee. Some of these cleaning devices, particularly those including a squeegee, require a large number of parts/components. As a result, these cleaning devices are expensive and/or time consuming to manufacture. To decrease costs and time, parts/components are sometimes made using inferior materials.

Therefore, it would be desirable to provide cleaning devices adapted to clean floors and including a squeegee, and methods of manufacture of such cleaning devices, which will reduce one or more of the problems encountered with one or more of the existing cleaning devices and/or their methods of manufacture.

SUMMARY OF THE INVENTION

In an embodiment, a squeegee is disclosed. The squeegee includes a foam blade assembly and a rubber blade secured in and/or to a main body. The foam blade assembly includes a plurality of posts which project through sets of coaxial openings in the main body and rubber blade and a plurality of fastening structures (e.g., wingnuts) engage the posts to secure the foam blade assembly and rubber blade to the main body.

In an embodiment, a method of assembling a squeegee is disclosed. The method includes providing a foam blade, channel structure, main body and rubber blade as described above, securing the foam blade to the channel structure to form a foam blade assembly as described above, positioning the rubber blade in a channel of the main body to form sets of corresponding coaxial openings, positioning the foam blade assembly with respect to the main body such that posts of the foam blade assembly engage the sets of corresponding coaxial openings and securing the foam blade assembly and rubber blade to the main body using a plurality of fastening structures (e.g., wingnuts) that engage the ends of the posts.

In an embodiment, a method of manufacturing a squeegee is disclosed. The method includes casting a main body, providing a foam blade, channel structure, the main body and rubber blade as described herein, securing the foam blade to the channel structure to form a foam blade assembly as described herein, positioning the rubber blade in a channel of the main body to form sets of corresponding coaxial openings, positioning the foam blade assembly with respect to the main body such that posts of the foam blade assembly engage the sets of corresponding coaxial openings and securing the foam blade assembly and rubber blade to the main body using a plurality of fastening structures (e.g., wingnuts) that engage the ends of the posts.

Various other aspects, objects, features and embodiments of the present disclosure are disclosed with reference to the following specification, including the drawings.

Notwithstanding the above examples, the present disclosure is intended to encompass a variety of other embodiments including for example other embodiments as are described in further detail below as well as other embodiments that are within the scope of the claims set forth herein.

BRIEF DESCRIPTION OF THE DRAWINGS

Embodiments of the disclosure are disclosed with reference to the accompanying drawings and are for illustrative purposes only. The disclosure is not limited in its application to the details of construction or the arrangement of the components illustrated in the drawings. The disclosure is capable of other embodiments or of being practiced or carried out in other various ways. Like reference numerals are used to indicate like components. In the drawings.

DETAILED DESCRIPTION OF THE DRAWINGS

Figure 1:
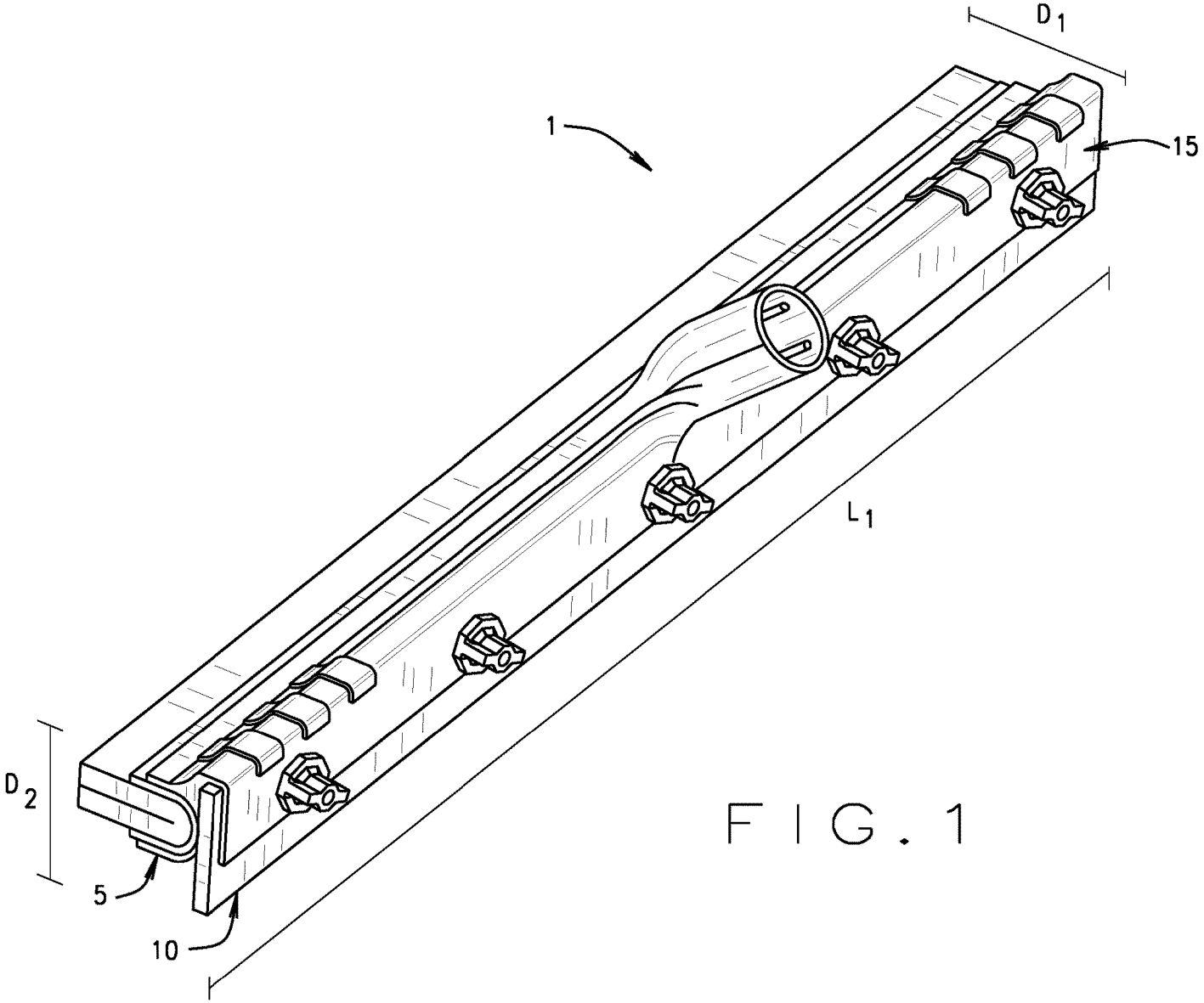
FIG. 1 is a rear perspective view of a squeegee in accordance with embodiments of the present disclosure.

FIG. 1 is a rear perspective view of a squeegee 1 in accordance with embodiments of the present disclosure. The squeegee 1 includes a foam blade assembly 5 and a rubber blade 10. The foam blade assembly 5 and rubber blade 10 may be secured in and/or to a main body 15. The dimensions of the squeegee 1 may vary depending on intended use, cost point, manufacturing constraints and other various factors. In the embodiment shown, the squeegee 1 has a total length $L_1$ of 24.35 inches, a distance $D_1$ of 4.82 inches (from the handle-receiving opening to the folded foam blade), and a distance $D_2$ of 4.88 inches (from the handle-receiving opening to the rubber blade). However, as will be understood, these dimensions are merely exemplary, and should not be seen as limiting.

Figure 2:
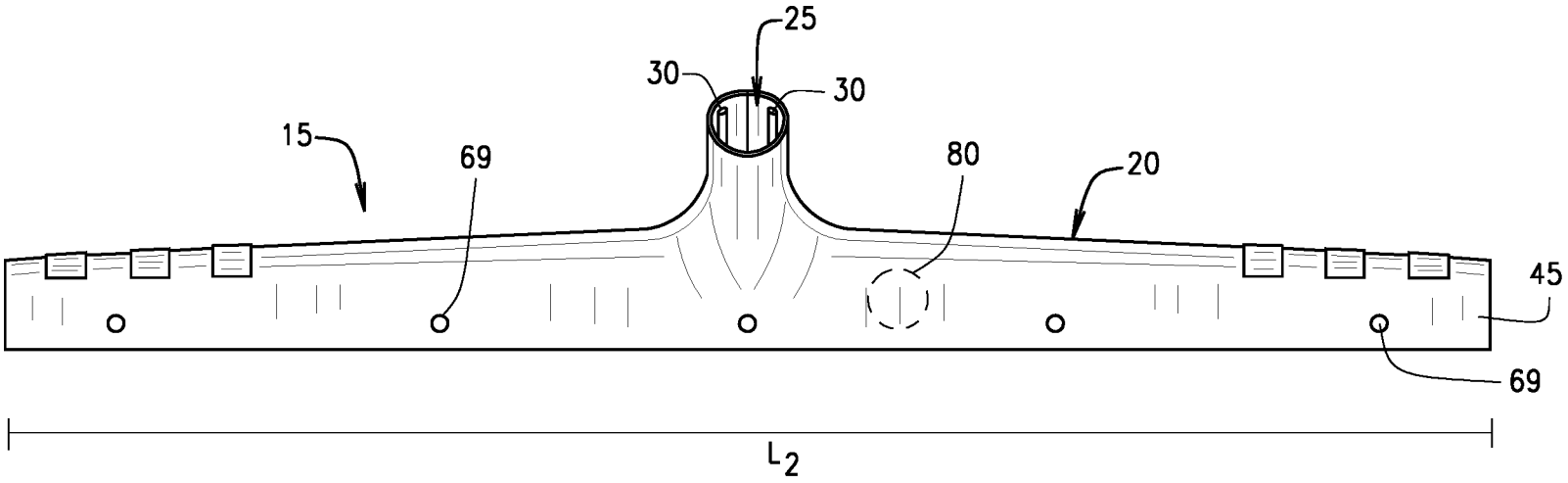
FIG. 2 is a rear elevation view of the main body of FIG. 1.
Figure 3:
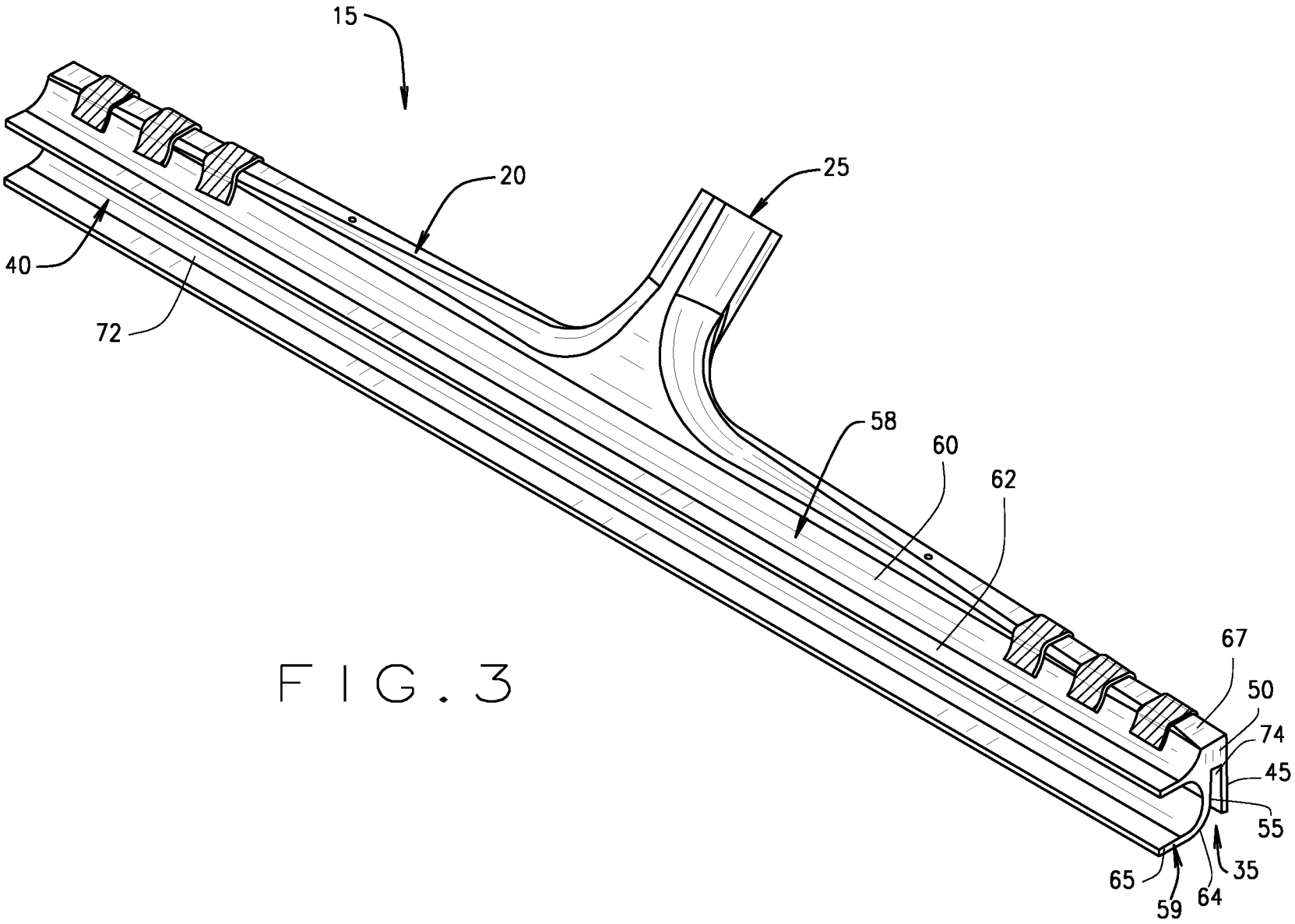
FIG. 3 is a front perspective view of the main body of FIG. 2.

As shown in FIGS. 2 and 3, the main body 15 may include an upper surface 20 which includes a handle-receiving opening 25. In an embodiment, the handle-receiving opening 25 may have one or more internal structures 30. The internal structures 30 may include (but are not limited to) threads, interlocking components or the like, which are configured to engage corresponding structures on a handle to lock or secure the handle to the main body 15, as shown in FIG. 2. For example, the internal structures 30 may be include four dovetail-like structures. However, in further embodiments, the internal structures 30 may include threads, dados, and other interlocking components or combinations thereof.

Referring to FIG. 3, the main body 15 may also include a rubber blade receiving channel 35 and a foam blade receiving channel 40. The rubber blade receiving channel 35 may have a generally rectangular cross-section and may run the length of the main body 15. The rubber blade receiving channel 35 may be formed by a projection 45 extending downward from the upper surface 20 along a rear edge of the upper surface 20, a planar surface 50 located and positioned adjacent to projection 45 along upper surface 20, and a projection 55 which extends downward from planar surface 50 opposite to projection 45. In the embodiment shown, the projection 45 and projection 55 are parallel to, or substantially parallel to, one another.

The rubber blade receiving channel 35 has an internal channel width corresponding to the thickness of the rubber blade 10. In an embodiment, the internal channel width is from 0.150 inches to 0.230 inches, or 0.214 inches. In the embodiment shown, projection 45 is approximately 0.125 inches thick. Again, these values are merely exemplary, and should not be viewed as limiting.

FIG. 3 shows the foam blade receiving channel 40 having a generally U-shaped cross-section and extends the length of the main body 15. The foam blade receiving channel 40 is formed by a first arcuate projection 58 of the upper surface 20 which extends away from the handle-receiving opening 25, and a second arcuate projection 59, which extends downwards from first arcuate projection 58 and away from the handle-receiving opening 25. The first arcuate projection 58 includes a concave projection 60 and planar extension 62, while the second arcuate projection 59 includes projection 55 (discussed above), concave projection 64, and planar extension 65. In the embodiment shown, the substantially planar portion 67 of the upper surface 20, planar extension 62, and planar extension 65 are parallel to, or are substantially parallel to, one another.

The foam blade receiving channel 40 has an internal channel width corresponding to the external width of the foam blade assembly 5, as described in further detail below. In an example non-limiting embodiment, the foam blade receiving channel 40 has an inner diameter of 0.920 inches, and each of the portion of the upper surface 20 and planar extension 65 which form the foam blade receiving channel 40 have a thickness of 0.125 inches.

Figure 4:
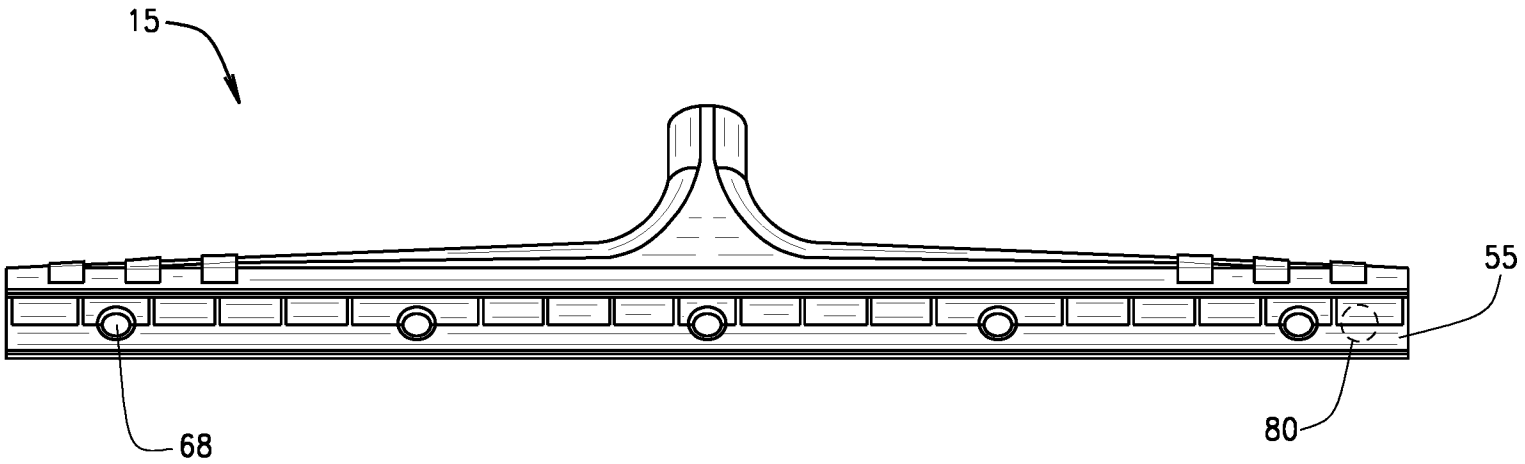
FIG. 4 is a front elevation view of the main body of FIGS. 2 and 3.
Figure 5:
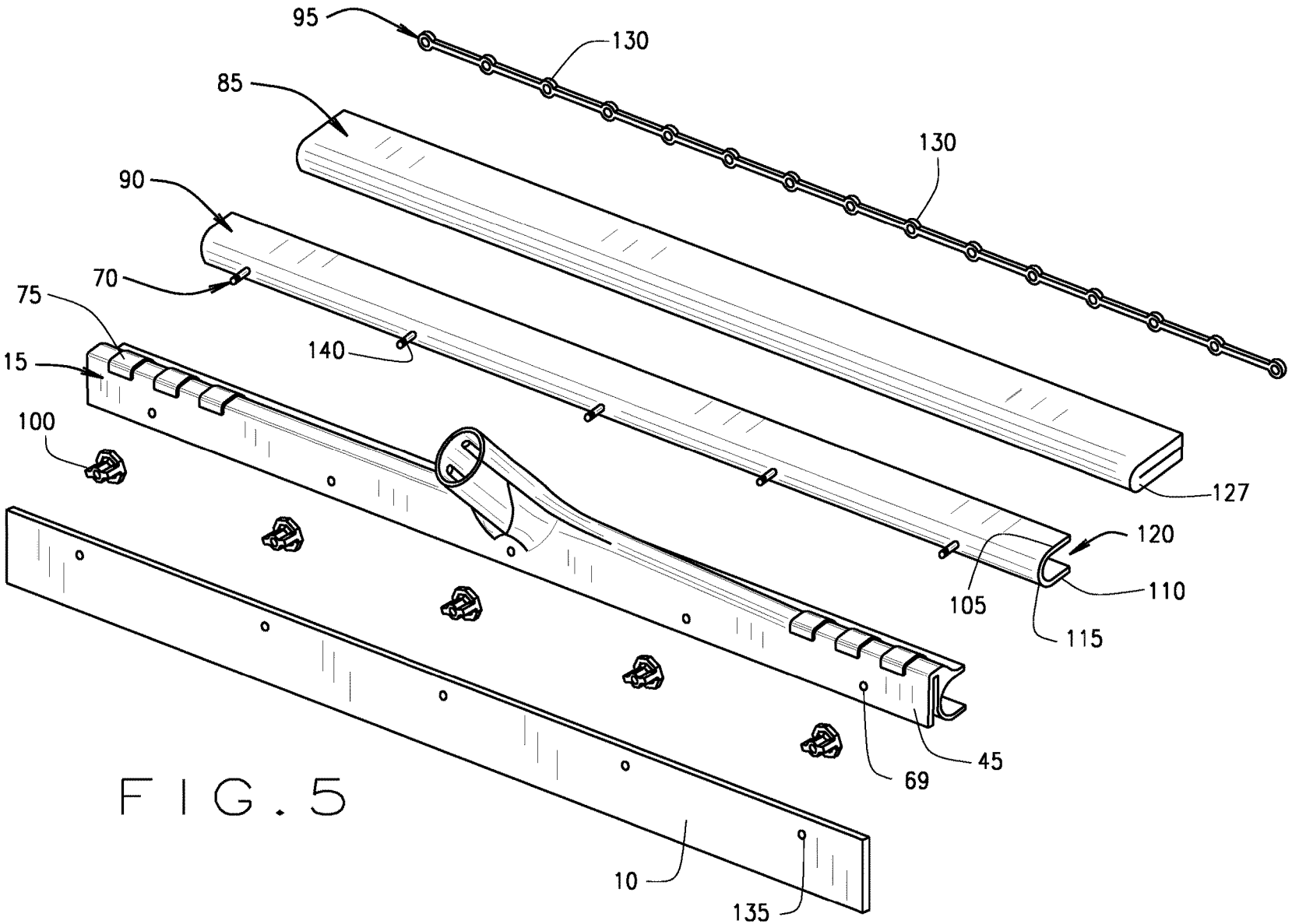
FIG. 5 is a rear exploded perspective view of the squeegee of FIG. 1.

FIG. 4 shows that the main body 15 may also include a first plurality of openings 68 extending through projection 55. FIGS. 2 and 5 show that the main body 15 further includes a corresponding second plurality of openings 69 extending through projection 45. FIGS. 4 and 5 illustrate that corresponding sets of first and second openings 68 and 69 may be coaxial, with sets of corresponding coaxial openings forming passages extending through the main body 15. In the embodiments shown, each of the openings of the pluralities of openings 68, 69 are shown having the same inner diameter. In other embodiments, the first and second pluralities of openings 68, 69 may have different inner diameters.

As will be described in further detail, the first and second openings 68, 69 are configured to receive corresponding first posts 70 on the foam blade assembly 5. The number of first openings 68 therefore preferably corresponds to, or is otherwise equal to, the number of second openings 69. The number of second openings 69 preferably corresponds to, or is otherwise equal to, the number of first posts 70. For example, FIGS. 2 and 4-5 show five sets of coaxial first and second openings 68, 69. Moreover, it will be appreciated that the internal shape and dimensions of the first and second openings 68, 69 corresponds to the external shape and dimensions of the first posts 70. For example, in the embodiment shown, the first posts 70 (see FIG. 6) are cylindrical with a circular cross section having an outer diameter. The first and second openings 68, 69 are therefore circular having an internal diameter of greater than or equal to the outer diameter of the first posts 70. In the embodiment shown in FIGS. 2 and 4-5, first and second openings 68, 69 have an inner diameter of 0.375 inches.

In further embodiments, the interior surface 72 of the foam blade receiving channel 40 may contain additional structures or contours which assist in engaging or aligning the foam blade assembly 5 in the foam blade receiving channel 40 (not shown). Similarly, one or more interior surfaces 74 of the rubber blade receiving channel 35 may include structures or contours which assist in engaging or aligning the rubber blade 10 in the rubber blade receiving channel 35.

Figure 6:
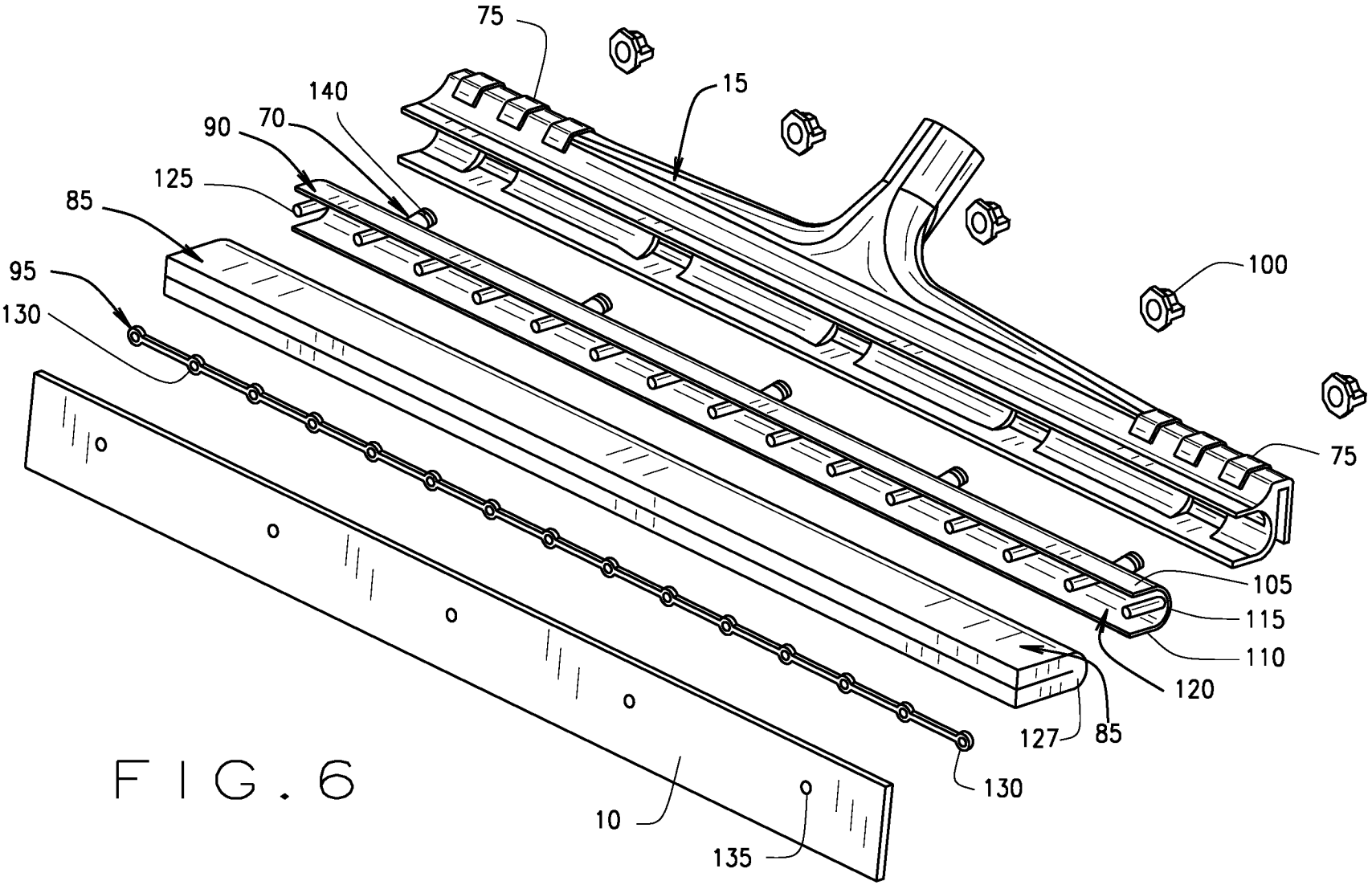
FIG. 6 a front exploded perspective view of the squeegee of FIGS. 1 and 5.

As shown in FIGS. 5 and 6, the main body 15 may further include textured or cushioned regions 75 or other markings, whether for aesthetic design or to provide a cushioning effect if the main body 15 impacts a surface during use. As shown in FIGS. 2 and 4, the main body 15 may also include designated regions or areas 80 which may contain manufacturing data or other information (e.g., quality markings, date of manufacture, manufacturing identification, quality test indications, etc.)

The dimensions of the main body 15 may vary depending on the desired size, shape and configuration of the squeegee 1. For example, in the embodiment shown, the main body 15 has a total length $L_2$ of 24.00 inches (see FIG. 2), a total distance of 4.31 inches from handle-receiving opening 25 to rubber blade receiving channel 35, and a total distance of 3.81 inches from handle-receiving opening 25 to foam blade receiving channel 40.

The main body 15 may be made of any suitable material, including, for example, plastic, metal, and combinations of these and other materials. In the exemplary embodiment shown, the main body 15 is made of 20% glass reinforced cast polypropylene. The total weight of the main body 15 when made of 20% glass reinforced cast polypropylene may be 328 grams in an example and non-limiting embodiment.

As can be seen in FIGS. 5 and 6, the foam blade assembly 5 may be composed of a folded blade 85 which may be made of foam or any other suitable material. Foam blade assembly 5 may also include a channel structure 90 and a channel insert 95. The foam blade assembly 5 and rubber blade 10 may be secured to the main body 15 by way of a first plurality of posts 70, extending from the channel structure 90 and through the main body 15 and rubber blade 10, and fastening structures 100 to secure such components together (described in more detail hereinafter).

The foam blade 85 may be folded in half length-wise and secured in channel structure 90 using channel insert 95. The channel structure 90 has two substantially planar and parallel portions 105, 110 connected by an arcuate portion 115 which together form a channel 120 having a generally U-shaped cross-section. A second plurality of posts 125 project from the arcuate portion 115 into the channel 120. In the embodiment shown, there are fifteen second posts 125, although more or fewer are contemplated. As shown, the foam blade 85 may be positioned in the channel 90 with the folded portion 127 of the foam blade 85 against the inside surface of arcuate portion 115 of the channel structure 90 such that the second posts 125 stretch or puncture through the foam blade 85. The channel insert 95 secures the foam blade 85 in the channel 90 by engaging (e.g., frictionally engaging) the second posts 125. The channel insert 95 may be press fit to an exemplary and non-limiting depth of 0.56 inches onto the second posts 125.

The second posts 125 of the channel structure 90 pass through the foam blade 85. The channel insert 95 therefore fits directly on the second posts 125. In one embodiment, the foam blade 85 may include holes or openings along its folded portion 127 which correspond to the location of the second posts 125 (not shown). During assembly, the second posts 125 slide through and engage the openings. In other embodiments, the foam blade 85 may not include any holes or openings prior to assembly. The second posts 125 then puncture the folded portion 127 of the foam blade 85 as the foam blade 85 is secured in the channel structure 90.

FIG. 6 shows that the channel structure 90 may further include a first plurality of posts 70 also extending from the arcuate portion 115, but outwardly away from the channel 120 (i.e., outward from the outer surface of the arcuate portion 115) as opposed to into the channel 120 as with second posts 125. As described above, the first posts 70 correspond to the first and second openings 68, 69 in the main body 15. While the number of first posts 70 corresponds to the number of corresponding coaxial sets of first and second openings 68, 69 in the main body 15, the number of first posts 70 in some embodiments may be less than the total number of corresponding first and second openings 68, 69.

The size (e.g., length, outer dimensions, etc.) and shape of the first posts 70 may vary and in some embodiments depends on the size and materials of the main body 15 and/or the size, shape and configuration of first and second openings 68, 69 in the main body 15. For example, in the embodiment shown, the first and second openings 68, 69 are circular with first posts 70 being cylindrical with a circular cross-section. The first and second openings 68, 69 may have an internal diameter of approximately 0.375 inches and the first posts 70 may have an outer diameter of approximately 0.36 inches. The distance from the end of first posts 70 to the end of the foam blade 85 when secured in the channel 90 may be 1.715+/−0.125 inches. In further embodiments, the shape and size of the openings 68, 69 and first posts 70 may vary, as would be understood by a person of ordinary skill in the art.

In further embodiments, the outer surface 127 of the arcuate portion 115 may include additional structures or contours which assist in engaging or aligning the foam blade assembly 5 in the foam blade receiving channel 40. For example, a groove or recess with a corresponding protuberance located in the foam blade receiving channel 40, or vice versa (not shown).

The dimensions of the channel structure 90 and the materials from which the channel structure 120 is made may vary depending on the ultimate size, shape, configuration and use of the squeegee 1. In the particular embodiment shown, the channel structure 90 is made of polyoxymethylene. The total weight of the channel structure 90 when made of polyoxymethylene in this embodiment is 94 grams.

As shown in FIGS. 5 and 6, the channel insert 95 may include a plurality of openings 130 configured to engage the second posts 125. The channel insert 95 may have a length equal to or less than that of the channel structure 90, with the openings 130 spaced along the length of the insert 95. Particularly, because the openings 130 are designed to engage the second posts 125, the spacing of the openings 130 on the channel insert 95 preferably matches the spacing of the second posts 125. In the specific embodiment shown, the second posts 125 are evenly spaced along the length of the channel structure 90, and the openings 130 are likewise evenly spaced along the length of the channel insert 95. The number of openings 130 of the channel insert 95 corresponds to the number of second posts 125 of the channel structure 90 (e.g., 15). In other embodiments, the number of openings 130 may be more or less than the number of second posts 125.

In order to secure the foam blade 85 in the channel 120, the channel insert 95 press fits into the channel 120 to engage the second posts 125. The openings 130 of the channel insert 95 frictionally engage the second posts 125, thereby securing the foam blade 85 in position in the channel 120 of the channel structure 90. It will therefore be appreciated that the size and shape of the openings 130 corresponds to the size and shape of the posts 125. For example, the second posts 125 are generally cylindrical with a circular cross-section having an outer diameter, and the openings 130 are generally circular with an inner diameter generally equal to or otherwise corresponding the outer diameter of the second posts 125 such that the openings 130 are designed to friction fit around the posts 125. In other embodiments, the shape and size of the second posts 125 and corresponding openings 130 may vary.

In still further embodiments, the second posts 125 and/or inner surface of the openings 130 may include one or more corresponding contours to assist in aligning or securing the openings 130 around the second posts 125 and/or securing the foam blade 85 in position.

In an embodiment, the posts second 125 stretch the material of the foam blade 85 when receiving the openings 130 of the channel insert 95. In other embodiments, the second posts 125 may pierce the foam blade 85 when receiving the openings 130 of the channel insert 95.

The channel insert 95 may be made of any suitable material. In one embodiment, the channel insert 95 is made of polyoxymethylene. The total weight of the channel insert 95 when made of polyoxymethylene may be 14 grams in a non-limiting example embodiment.

The specific dimensions of the foam blade 85 may vary depending on intended size and use of the squeegee, as well as the materials used and other considerations. In one embodiment, the foam blade 85 has a total thickness of 0.37 inches, resulting in a total folded thickness of 0.74 inches. In an embodiment, the distance from the deepest part of the U-shaped channel 120 to the edge of the folded foam blade 85 is 1.87 inches. In an embodiment, the foam blade 85 has a length of 24.350+/−0.125 inches. In an embodiment, the U-shaped channel 120 has a length equal to that of the folded foam blade 85. In a further embodiment, the U-shaped channel 120 has a length less than that of the folded foam blade 85, such that the foam blade 85 overhangs the channel structure 90. In an embodiment, the overhang of the foam blade 85 is 0.20 inches on both sides of the channel structure 90. Of course, other dimensions are also envisioned.

The material of the foam blade 85 may also vary depending on the intended use of the squeegee. For example, in one embodiment, the foam blade 85 is made of moss rubber. In further embodiments, any suitable foam or rubber may be used.

In an embodiment, FIGS. 5 and 6 show a rubber blade 10 for use with a squeegee 1. The rubber blade 10 includes a plurality of openings 135 corresponding to the first and second pluralities of openings 68, 69 of the main body 15. The size and shape of the openings 135 preferably corresponds to that of the first and second openings 68, 69 as well as the size and shape of first posts 70 as will be described in further detail below. Therefore, in the embodiment shown, the rubber blade 10 includes five openings 135 which are circular in shape and have an inner diameter of 0.38 inches.

The rubber blade 10 has a size and shape configured to engage the rubber blade receiving channel 35 of the main body 15. In an embodiment, the length of the rubber blade 10 is approximately equal to the length of the rubber blade receiving channel 35; however, in further embodiments, the length of the rubber blade 10 may be slightly less than or slightly greater than the length of the rubber blade receiving channel 35, as long as the rubber blade 10 can be secured in the rubber blade receiving channel 35. The rubber blade 10 may have a length of greater than that of the channel structure 90 and the main body 15, with a total overhang of 0.20 inches on either side of the channel structure 90/main body 15.

Similarly, the height of the rubber blade 10 may vary, so long as it can be secured in the rubber blade receiving channel 35 and projects at least a distance outward from the channel 35 so as to contact a surface to be cleaned. The width of the rubber blade 10 is also selected so that the rubber blade 10 can be inserted into the rubber blade receiving channel 35 and secured in position. In an embodiment, the width of the rubber blade 10 is equal to or less than the width of the rubber blade receiving channel 35. Particularly, in one embodiment, the rubber blade 10 has a length of 24.350+/−0.125 inches, a height of 1.980+/−0.125 inches, and a width of 0.214 inches. Other dimensions are also envisioned.

The material of the rubber blade 10 may vary depending on the intended use of the squeegee. For example, different grades of rubber may have a different hardness, resistance to wear, etc. In the embodiment shown, the rubber blade 10 is made of rubber having a Shore A hardness of 70+/−5. Other hardness ratings and properties are also envisioned.

The foam blade assembly 5 and rubber blade 10 connect and secure to the main body 15. The foam blade 85 fits in the channel 120 of the channel structure 90, and the channel insert 95 frictionally engages the second posts 125. The rubber blade 10 engages the rubber blade receiving channel 35 of the main body 15 such that the openings 135 align with first and second openings 68, 69, thereby creating sets of corresponding coaxial openings of each of the pluralities of first and second openings 68, 135, 69 (in order and as shown in FIGS. 2, 5, and 6). As the foam blade assembly 5 is inserted into the foam blade 85 receiving channel 40, each of the first posts 70 aligns with a corresponding set of coaxial openings so as to pass through the corresponding set of corresponding coaxial openings, with the ends of the first posts 70 projecting through and extending from the main body 15.

Figure 7:
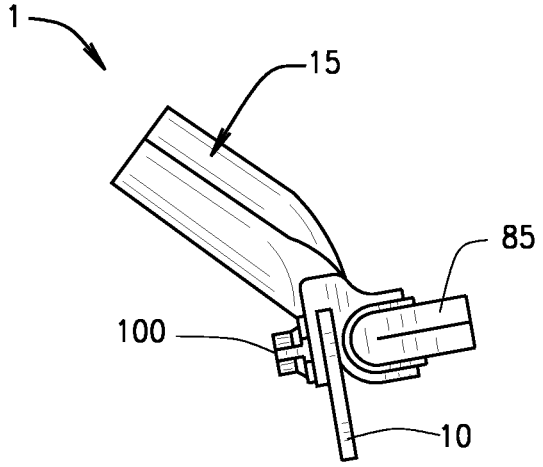
FIG. 7 is a side elevation view of the squeegee of FIGS. 1 and 5-6.
Figure 8:
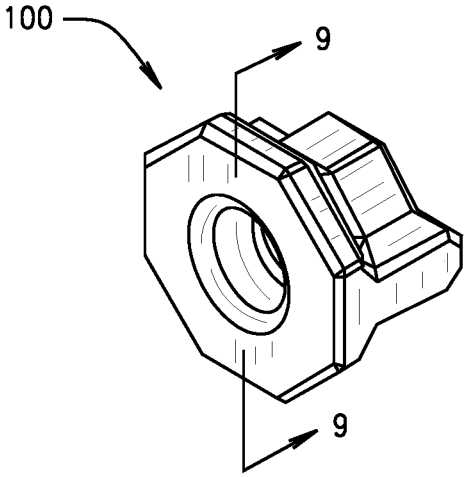
FIG. 8 is a front perspective view of the fastening structure.
Figure 9:
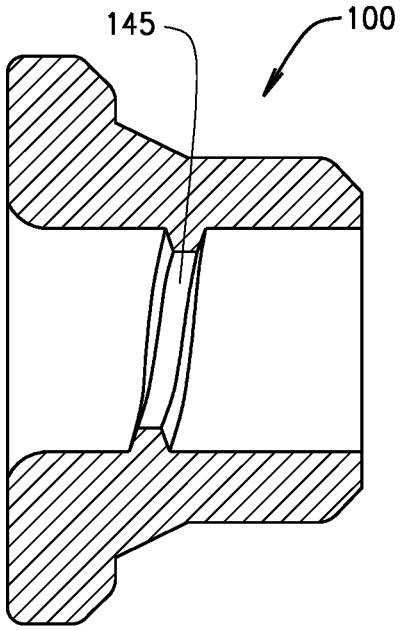
FIG. 9 is a cross sectional view of the fastening structure of FIG. 8 taken along line 9-9.

In the embodiment shown, the ends of the posts 70 which extend from the main body 15 when the foam blade assembly 5 and rubber blade 10 are positioned with respect to the main body 15 include one or more external structures 140 which are configured to engage corresponding structures 145 on fastening structures 100 which secure to the ends of the first posts 70. For example, the one or more external structures 140 are threads, and the fastening structures 100 are wingnuts with an inner thread 145 (see FIGS. 6-9). The fastening structures 100 are tightened to the threads 140 on the ends of the first posts 70, thereby securing or locking the foam blade assembly 5 to the main body 15, with the rubber blade 10 likewise secured or locked to the main body 15 because the first posts 70 extend through the openings 135 of the rubber blade 10 as seen in FIGS. 1 and 7.

The size and material of the fastening structures 100, as well as the specifics and various dimensions of the corresponding structures 145 of the fastening structures 100 will vary depending on the shape, size and external structures 140 of the first posts 70. In the embodiment shown, the fastening structures 100 are wingnuts made of cast polypropylene with each fastening structure 100 having a weight of 3 grams. In an embodiment, the cast polypropylene may be the same 20% glass filled cast polypropylene used to make the main body 15.

The number, size, shape and material of the fastening structures 100 may also vary depending on the particular size, shape and material of the various openings and posts to which the fastening structures 100 will be attached. For example, because there are five first posts 70, there are a total of five fastening structures 100 in the embodiments shown. Moreover, in the particular embodiment shown, the fastening structures 100 are wingnuts having a groove pattern corresponding to the threads on the outer surface of the ends of the first posts 70.

The present disclosure provides a method for assembling and/or manufacturing a squeegee. In an embodiment the method for assembling the squeegee comprises providing a foam blade, channel structure, main body and rubber blade as described above, securing the foam blade to the channel structure to form a foam blade assembly as described above, positioning the rubber blade in a channel of the main body to form sets of corresponding coaxial openings, positioning the foam blade assembly with respect to the main body such that posts of the foam blade assembly engage the sets of corresponding coaxial openings and securing the foam blade assembly, and therefore rubber blade, to the main body using a plurality of fastening structures (e.g., wingnuts) that engage the ends of the posts.

In an embodiment, the step of securing a foam blade to a channel structure includes securing a folded foam blade in the channel of a channel structure by sandwiching the folded foam blade between the channel structure and a channel insert which frictionally engages posts in the channel of the channel structure.

In an embodiment a method of manufacturing a squeegee comprises casting a main body, providing a foam blade, channel structure, the main body and rubber blade as described above, securing the foam blade to the channel structure to form a foam blade assembly as described above, positioning the rubber blade in a channel of the main body to form sets of corresponding coaxial openings, positioning the foam blade assembly with respect to the main body such that posts of the foam blade assembly engage the sets of corresponding coaxial openings and securing the foam blade assembly, and therefore rubber blade, to the main body using a plurality of fastening structures (e.g., wingnuts) that engage the ends of the posts.

In an embodiment, the step of securing a foam blade to a channel structure includes securing a folded foam blade in the channel of a channel structure by sandwiching the folded foam blade between the channel structure and a channel insert which frictionally engages posts in the channel of the channel structure.

Many other variations to the high performance squeegee, related manufacturing methods, and respective components, are possible and considered within the scope of the claims. Moreover, the components can be sized and shaped depending on the overall intended use and/or application of the squeegee and can be varied, to at least some extent, without departing from the scope of the present invention.

It is specifically intended that the present disclosure not be limited to the embodiments and illustrations contained herein, but include modified forms of those embodiments including portions of the embodiments and combinations of elements of different embodiments as come within the scope of the following claims.

What is claimed is:

1. A squeegee comprising:

a main body having a rubber blade receiving channel, a foam blade receiving channel, and a first plurality of openings;

a foam blade assembly including a foam blade and a channel structure, the foam blade being located and positioned within the channel structure; and a rubber blade having a second plurality of openings;

wherein the channel structure of the foam blade assembly further including a plurality of posts, the channel structure being located and positioned within the foam blade receiving channel;

wherein the plurality of posts extend through the first and second plurality of openings of the main body and rubber blade to secure the foam blade within the foam blade receiving channel and the rubber blade within the rubber blade receiving channel.

2. The squeegee of claim 1 wherein the main body has cushioned regions.

3. The squeegee of claim 1 wherein the main body is comprised of 20% glass reinforced cast polypropylene.

4. The squeegee of claim 1 wherein a handle receiving opening includes threads configured to engage with a corresponding structure on a handle.

5. The squeegee of claim 4 wherein the handle receiving opening includes four dovetail threads.

6. The squeegee of claim 1 wherein the main body includes designated regions which may have information listed.

7. The squeegee of claim 1 wherein the squeegee includes the foam blade assembly, wherein the foam blade assembly includes the channel structure.

8. The squeegee of claim 7 wherein the channel structure includes a first plurality of posts, wherein the first plurality of posts punctures through the foam blade when the squeegee is assembled.

9. The squeegee of claim 1 wherein the foam blade is folded, the folded foam blade includes holes or openings along a folded portion.

10. A squeegee comprising:

a main body having a rubber blade receiving channel, a foam blade receiving channel, a first plurality of openings, and a second plurality of openings;

a rubber blade having a third plurality of openings; and a foam blade assembly including a channel insert, a channel structure, and a folded foam blade positioned in the channel structure between the channel structure and the channel insert, wherein the channel structure having a first plurality of posts and a second plurality of posts, the second plurality of posts extending through the folded foam blade;

wherein the channel insert selectively engages the second plurality of posts;

wherein the foam blade assembly and the rubber blade are secured to the main body;

wherein the third plurality of openings of the rubber blade is aligned with the first plurality of openings and the second plurality of openings of the main body;

wherein the first plurality of posts being inserted through the first plurality of openings of the main body, the second plurality of openings of the main body, and the third plurality of openings of the rubber blade; and wherein a plurality of fasteners engages with the first plurality of posts.

11. The squeegee of claim 10 wherein the main body has cushioned regions.

12. The squeegee of claim 10 wherein the main body is comprised of 20% glass reinforced cast polypropylene.

13. The squeegee of claim 10 wherein a handle receiving opening includes threads configured to engage with a corresponding structure on a handle.

14. The squeegee of claim 10 wherein the first plurality of posts punctures through the folded foam blade when the squeegee is assembled.

15. The squeegee of claim 10 wherein the folded foam blade includes holes or openings along a folded portion.

16. The squeegee of claim 10 wherein the channel structure comprises polyoxymethylene.

17. The squeegee of claim 10 wherein a handle receiving opening includes four dovetail threads.

* * * * *